US008251144B2

(12) United States Patent
Macfarlane

(10) Patent No.: US 8,251,144 B2
(45) Date of Patent: Aug. 28, 2012

(54) FLOW DIVERTER

(75) Inventor: Alastair Henry Walter Macfarlane, Angus (GB)

(73) Assignee: Andergauge Limited, Aberdeen (GB)

( * ) Notice: Subject to any disclaimer, the term of this patent is extended or adjusted under 35 U.S.C. 154(b) by 467 days.

(21) Appl. No.: 11/573,523

(22) PCT Filed: Aug. 8, 2005

(86) PCT No.: PCT/GB2005/003107

§ 371 (c)(1), (2), (4) Date: May 16, 2007

(87) PCT Pub. No.: WO2006/016137

PCT Pub. Date: Feb. 16, 2006

(65) Prior Publication Data

US 2008/0029268 A1 Feb. 7, 2008

(30) Foreign Application Priority Data

Aug. 10, 2004 (GB) ..... 0417731.7

(51) Int. Cl.
*E21B 37/00* (2006.01)

(52) U.S. Cl. ..... 166/311; 166/177.7; 166/222; 166/316; 175/38; 175/232; 175/317; 175/324

(58) Field of Classification Search ..... 175/38, 175/232, 317, 324; 166/311, 177.7, 222, 166/316

See application file for complete search history.

(56) References Cited

U.S. PATENT DOCUMENTS

| | | | | |
|---|---|---|---|---|
| 4,673,045 | A * | 6/1987 | McCullough | 175/339 |
| 4,817,739 | A * | 4/1989 | Jeter | 175/38 |
| 6,439,318 | B1 * | 8/2002 | Eddison et al. | 175/57 |
| 2004/0016540 | A1 * | 1/2004 | Jarchau et al. | 166/222 |
| 2004/0031613 | A1 * | 2/2004 | Martin | 166/311 |

OTHER PUBLICATIONS

International Search Report for International Appl. No. PCT/GB2005/003107 completed Sep. 30, 2005.

* cited by examiner

*Primary Examiner* — Daniel P Stephenson
*Assistant Examiner* — James Sayre
(74) *Attorney, Agent, or Firm* — Alston & Bird LLP

(57) ABSTRACT

A downhole tool comprises a body defining a fluid inlet and two or more fluid outlets. A valve arrangement cycles the proportion of fluid directed from the inlet to each of the outlets. One of the outlets may be associated with a fluid pressure responsive device, such as a cleaning blade.

46 Claims, 5 Drawing Sheets

FLOW DIVERTER

FIELD OF THE INVENTION

This invention relates to a downhole tool, and in particular a downhole tool which utilises flowing fluid.

BACKGROUND OF THE INVENTION

In the oil and gas exploration and production industry, subsurface hydrocarbon-bearing rock formations are accessed by drilling bores from surface, which bores are subsequently lined with metal tubing, known as casing or liner. During the drilling of the bore, and in many subsequent operations, drill bits or other tools are positioned in the bore on the end of an elongate tubular support, which may be sectional drill pipe or coiled tubing, for example. In many cases, fluid is pumped through the support, and this fluid may serve a number of different functions. In a drilling operation, the fluid may exit the drill pipe string through jetting nozzles at the drill bit, the jets of fluid assisting in dislodging material from the cutting face. The drilling fluid then assists in carrying the cuttings to surface. The fluid may also be used as a means to actuate tools, for example by providing flow restrictions in the bore or by use of differential pistons.

It is among the objectives of embodiments of the present invention to enhance the operation of downhole tools which, at least to some extent, utilise fluid in their operation.

SUMMARY OF THE INVENTION

According to the present invention there is provided a downhole tool comprising:

a body defining a fluid inlet and a plurality of fluid outlets; and a valve arrangement for selectively varying the proportion of fluid directed from the inlet to each of the outlets.

The invention has utility in a range of applications in which it is useful to have a pulsed, intermittent, or varying flow from different fluid outlets.

Preferably, the configuration of the valve arrangement is adapted to be substantially continuously variable. Thus, in use, the fluid flow path through the body between the inlet and the outlets is continuously or cyclically changed. Preferably, the flow path is changed at least once a second, and preferably several times per second, typically around 15 Hz.

The nature of the flow from the different outlets may be the same, substantially the same, or may be different. Most preferably, one outlet provides a relatively high velocity flow, which may be useful for cutting or dislodging debris. Another outlet may provide a relatively high volume flow, useful for entraining material in the fluid.

The valve arrangement may be configured to provide substantially continuous fluid communication between the inlet and one or more of the outlets. Indeed, the inlet may communicate with at least one of the outlets independently of the valve, that is fluid may flow from the inlet to an outlet without passing through the valve. Alternatively, or in addition, the valve arrangement may be configured to provide intermittent communication between the inlet and one or more of the outlets.

The valve arrangement may be arranged to selectively direct fluid from the inlet to one or more pressure responsive devices. Such devices may include extendable members, such as cutters, scrapers, pins or needles. The pressure responsive devices may be in communication with a flow path between the inlet and an outlet.

Preferably, the valve arrangement is motor driven. Most preferably, a positive displacement motor drives the valve arrangement.

In one embodiment the valve arrangement includes a member which is fixed relative to the body and co-operates with a member which is movable relative to the body, though in other embodiments the valve may have two members which are movable relative to the body. One or both of the members may define one or more flow ports. The valve may control flow by selective alignment or misalignment of flow ports in the members, or by closing a port in one member using the other member.

The movable valve member may be adapted to rotate relative to the body or to move linearly relative to the body. In a preferred embodiment the movable valve member is adapted to both rotate and move transversely relative to the body. This may be achieved by mounting the valve member to the rotor of a Moineau principle positive displacement motor.

In one embodiment, the valve arrangement may be configured to open and close a flow port which communicates with a group of relatively large flow area outlet ports. The fluid inlet may be in continuous communication with a group of relatively small area ports. Thus, when the port is closed a greater proportion of fluid flow is directed to the small area ports, such that the tool provides high velocity pulsating fluid jets from the ports. These fluid jets may be useful for cutting and dislodging scale and other material from the interior of bore-lining tubing.

In another embodiment the valve arrangement is configured to selectively direct fluid to one group of outlet ports and then to another group of outlet ports axially spaced from said one group of outlet ports. Such an arrangement may be useful as, for example, an acidiser when it is desired to provide pulsed flows to achieve enhanced fluid penetration into a formation. A flow restricting member, such as a swab cup, may be provided between the groups of outlet ports. Such an arrangement may also be useful in cleaning sandscreens and the like, where movement induced by the pulsating flow may enhance the cleaning effect.

In another embodiment the valve arrangement is configured to direct flow to a first jetting nozzle and then to a second jetting nozzle provided in a cutting tool, such as a drill or a mill. The jetting nozzles may be of similar configuration but spaced apart, or may be configured to provide different flow velocities. The jetting nozzles may be oriented in different directions. The alternating supply between the nozzles is believed to provide more effective cuttings removal.

In a yet further embodiment the valve arrangement is configured to open and then close a flow port in a valve member communicating with radially movable pressure-actuated members and fluid outlets for directing fluid towards the members. The pressure-activated members may be cleaning members. When the flow port is closed the fluid may be directed to further fluid outlets, which may serve a cleaning or circulation function. In one specific embodiment the further fluid outlets may be directed upwardly towards further cleaning members, which may be in the form of brushes.

In a still further embodiment the valve arrangement is configured to direct flow to communicate with: a plurality of fluid-actuated members and a set of fluid outlets; and an alternative set of fluid outlets. The fluid actuated members may be in the form of extendable needles.

Preferably, the tool is adapted for location on an end of an elongate support, such as a tool string, drill string or coiled tubing. A leading end of the tool may be rounded or otherwise configured to facilitate advancement of the tool through a bore. Preferably, at least one fluid outlet is provided in the leading end of the tool, and is configured to direct a jet of fluid axially from the end of the tool. This may serve to further facilitate advancement of the tool, as the fluid will assist in dislodging or displacing material which has settled in an inclined bore.

Preferably, the tool is adapted to be agitated in use, which agitation may serve a number of purposes, including: assisting in the removal or dislodgement of material in the bore; and reducing the friction between the tool and the bore wall. The agitation may be produced by one or more means, including the movement of parts of the valve arrangement; movement of parts of a valve drive motor; and changes in the fluid flow path through the tool.

According to another aspect of the present invention there is provided a downhole tool comprising:

a body defining a fluid inlet and at least one fluid outlet;

a fluid pressure responsive device; and a valve arrangement for selectively varying the proportion of fluid directed from the inlet to each of the at least one fluid outlet and the fluid pressure responsive device.

BRIEF DESCRIPTION OF THE DRAWINGS

These and other embodiments of the invention will now be described, by way of example, with reference to the accompanying drawings, in which.

DETAILED DESCRIPTION OF THE DRAWINGS

Figure 1:
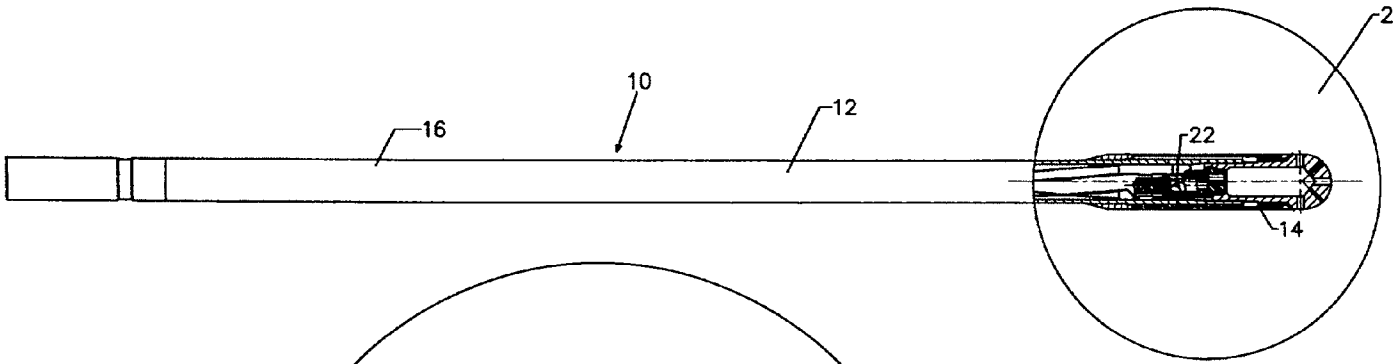
FIG. 1 is a part sectional view of an agitator cleaning tool in accordance with a first embodiment of the present invention.
Figure 2:
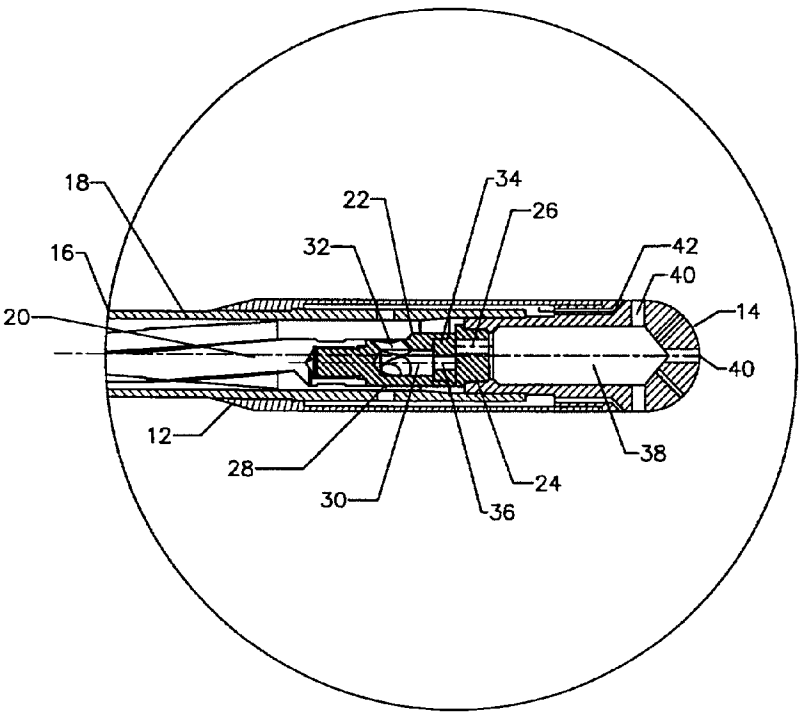
FIG. 2 is an enlarged view of part 2 of FIG. 1.

Reference is first made to FIGS. 1 and 2 of the drawings, which illustrate an agitator cleaning tool 10 in accordance with a first embodiment of the present invention. The tool comprises a generally cylindrical body 12 adapted for mounting to an elongate support, such as a drill pipe string. Alternatively, the body may be adapted for mounting on coil tubing, which permits the tool to be deployed and retrieved relatively rapidly. The leading end of the tool 10 comprises a jetting head 14, while a central portion of the tool comprises a positive displacement motor (PDM) 16, in this case a Moineau principle motor having a tubular body containing an external elastomeric outer gear or stator 18 and a central lobed rotor 20.

The jetting head 14 accommodates a valve arrangement 22 including a transverse valve plate 24 fixed relative to the body 12 and defining an axial flow passage 26. In this example the passage 26 is offset from the tool axis, but in other embodiments the passage may be aligned with the axis. The valve plate 24 co-operates with a valve member 28 mounted to the end of the rotor 20, such that the member 28 will be rotated and moved transversely when the motor 16 is operating, that is when fluid is being pumped through the motor.

The valve member 28 includes a central flow passage 30 which communicates, via inclined flow ports 32, with the exhaust from the motor 16. The lower end of the flow passage 30 comprises an insert 34 defining a flow port 36 which, in this example, is coaxial with the flow passage 30; in other embodiments the flow port may be offset from the flow passage. The insert 34 co-operates with the valve plate 24 such that, when the flow passage 26 is aligned with the flow port 36, fluid exhausting from the motor 16 may pass into a manifold 38 formed within the leading end of the jetting head 14. However, when the flow passage 26 and the flow port 36 are misaligned, as illustrated in FIGS. 1 and 2, flow into the manifold 38 may be restricted or prevented.

The manifold 38 communicates with a number of jetting nozzles 40 adapted to directed jets of fluid axially, transversely and at an inclined angle to the jetting head 14.

As noted above, when the flow passage 26 and the flow port 36 are misaligned, there is restricted access to the manifold 38 from the motor exhaust, and with the valve 22 in this configuration the primary exit for fluid is via a number of relatively small diameter inclined jetting nozzles 42.

In use, the tool 10 is located within a well bore, typically within a section of casing or liner which it is desired to clean. Fluid is pumped from surface through the support on which the tool 10 is mounted, and through the tool 10 itself. As the fluid passes through the motor 16 the rotor 20 is rotated, and thus the valve 22 is actuated. In particular, the valve member 28 is rotated and moved transversely relative to the valve plate 24. During the interval when the flow passage 26 in the valve plate 24 is aligned with the flow port 36 on the valve member 28, fluid may exit the jetting head 14 through all of the jetting nozzles 40, 42. However, as the valve member 28 is moved and the flow port 36 is moved out of alignment with the flow passage 26, the primary outlet for the fluid is through the relatively small area jetting nozzles 42. Accordingly, this produces relatively high velocity jets of fluid from the nozzles 42. The fluid energy available is enhanced by the fact the jetting nozzles 42 take fluid from above the valve 22, and it is also believed that the momentum of the fluid above the valve 22, which may be considerable, also enhances the jetting effect provided by the nozzles 42.

Tool 10 thus provides an alternating output that varies between a high velocity flow, useful for cutting and dislodging material, when all or most of the flow is directed through the small area jetting nozzles 42, and a lower velocity but higher volume flow when fluid flows through all of the jetting nozzles 40, 42. The latter higher flow rate is useful in entraining and flushing away material dislodged by the high velocity fluid jets.

The tool 10 may be rotated in use, and furthermore the operation of the motor 16 and of the valve 22 will tend to cause the tool 10 to move and vibrate within the bore, further enhancing the cleaning effect, and facilitating movement of the tool 10 through the bore.

Figure 3:
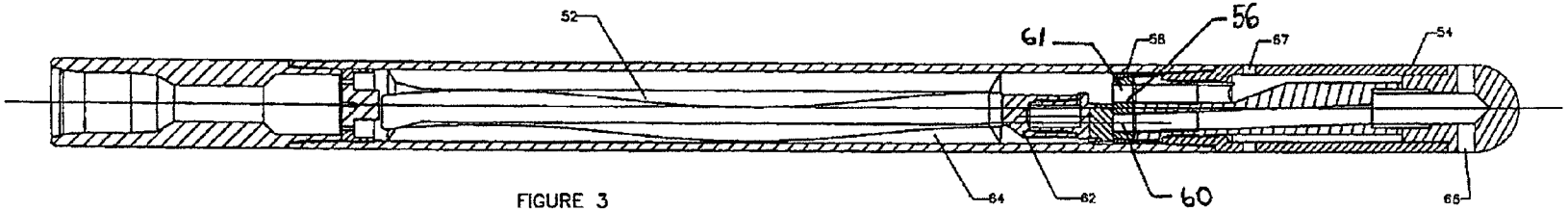
FIG. 3 is a sectional view of an acidiser tool in accordance with a second embodiment of the present invention.

Reference is now made to FIG. 3 of the drawings, which is a sectional view of an alternating flow tool 50, which may be used for stimulation or acidising in accordance with a second embodiment of the present invention. Like the tool 10 described above, the tool 50 is adapted for mounting on the lower end of an elongate support, and includes a positive displacement motor 52 and a jetting head 54, with a valve arrangement 56 providing between the motor 52 and the jetting head 54.

In this embodiment, the valve arrangement 56 comprises a valve plate 58 defining two flow passages 60, 61. The valve plate 58 co-operates with a valve member 62 mounted on the rotor 64 of the motor 52, the movable valve member 62 serving to selectively close the flow passages 60, 61 as it is rotated and moved transversely across the valve plate 58.

One of the flow passages 60 communicates with transverse jetting nozzles 66 located towards the end of the jetting head 54, whereas the other flow passage 61 communicates with an alternative set of jetting nozzles 67 which are spaced from the leading end of the jetting head 54.

In use, the tool 50 may be used to stimulate a formation by "acidising" the formation. In such a process, fluid is directed into the area of the formation surrounding a well bore with a view to improving the production of hydrocarbons from the formation.

The fluid, known as "acid", is pumped from surface through the supporting tool string and through the tool 50, and exits the tool 50 via the nozzles 66, 67. Of course as the acid flows through the tool and the motor 52, the valve member 62 is rotated to alternatively open and close the flow passages 60, 61, thus alternating flow between the nozzles 66, 67.

It is believed that the resulting pulsating flow from the axially spaced nozzles 66, 67 results in more effective penetration of the formation. It is also believed that the nature of the fluid flow from the nozzles 66, 67 facilitates cleaning of sandscreens and the like, the alternating flow facilitating dislodgment of material from the sandscreen.

In certain embodiments, it may be advantageous to locate a packing member or swab cup between the nozzles 66, 67, to isolate the alternating flow from the nozzles.

Figure 4:
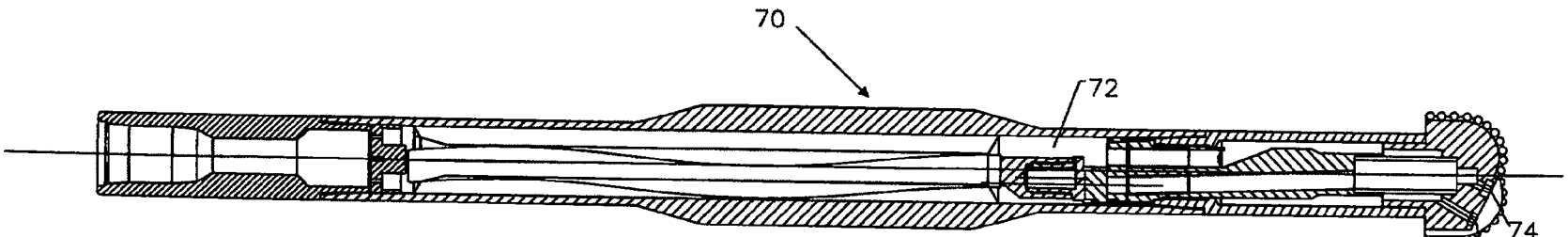
FIG. 4 is a sectional view of a jetted drill bit in accordance with a third embodiment of the present invention.

Reference is now made to FIG. 4 of the drawings, which is a sectional view of a jetted drill bit 70 in accordance with a third embodiment of the present invention. The bit 70 shares many features with the tool 50 described above, in that the drill bit includes a valve arrangement 72 which operates to direct fluid flow to different sets of jetting nozzles 74, 75. In this particular embodiment, the two sets of jetting nozzles 74, 75 are both located on the leading end of the drill bit 70, with the set of nozzles 74 lying closer to the main axis of the drill bit 70 being of larger area, to provide a lower velocity flow than the smaller diameter nozzle 75 which are located towards the outer diameter of the drill bit 70.

Figure 5:
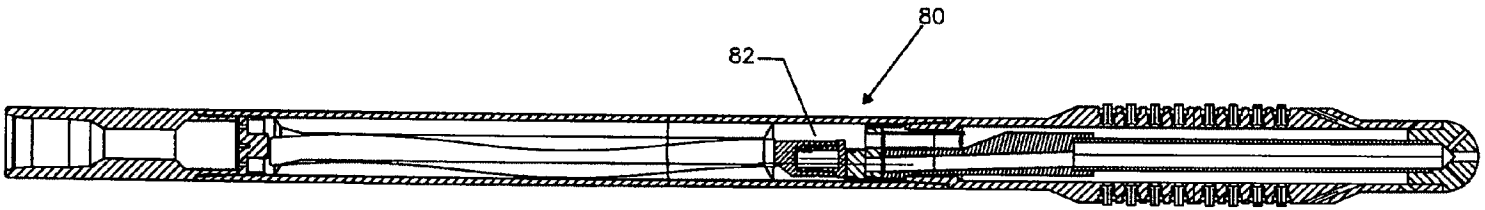
FIG. 5 is a sectional view of a downhole needle gun in accordance with a fourth embodiment of the present invention.
Figure 6:
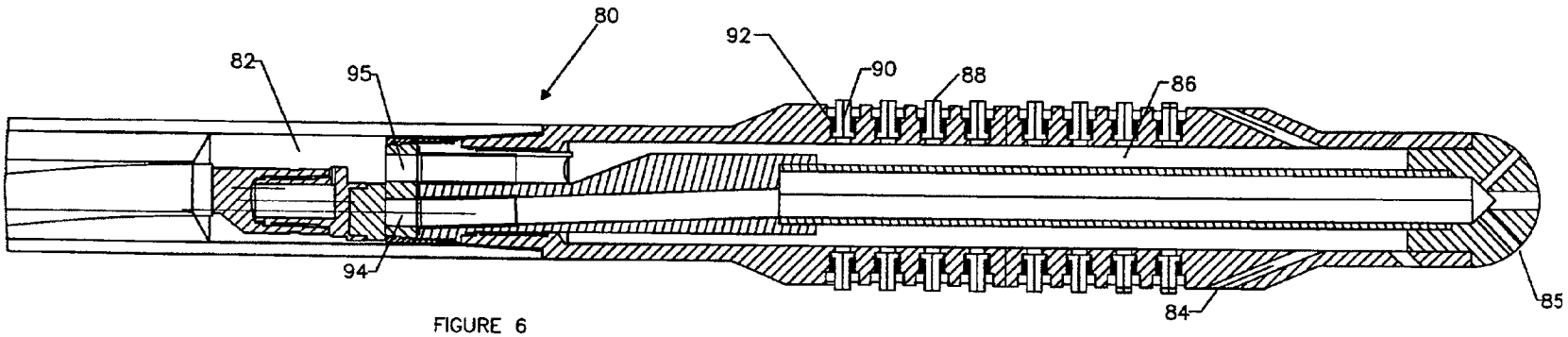
FIG. 6 is an enlarged sectional view of part of the gun of FIG. 5.

Reference is now made to FIGS. 5 and 6 of the drawings, which are sectional views of a downhole needle gun 80 in accordance with a fourth embodiment of the present invention. The needle gun 80 includes a similar valve arrangement 82 to those of the tools 50, 70 described above. However, in one configuration of the valve arrangement 82, flow is not only directed to a set of jetting nozzles 84, but also to a manifold 86 in communication a number of fluid actuated devices in the form of needles 88. Each needle comprises a small piston 90 and a return spring 92, such that when the flow passage 95 which communicates with the jetting nozzles 84 is open, as illustrated in the Figures, the elevated fluid pressure within the manifold 86 will cause the needles 88 to extend radially from the body of the needle gun 80, into contact with the surrounding casing or liner. This will of course assist in removing or dislodging material from the inner wall of the casing. This effect is enhanced by the jets of fluid exiting the gun 80 from the jetting nozzles 84, some of the jetting nozzles 84 being inclined upwardly to direct fluid towards the working area of the needles 88.

When the flow passage 95 is closed, and the other flow passage 94 is opened to permit fluid to exit the gun 80 through the alternative jetting nozzles 85, the needles 88 will retract.

As with the other embodiments described above, it is believed that the intermittent pulsating fluid flow from the jetting nozzles 84, 85 will enhance the cleaning effect achieved by the gun 80. Similarly, the intermittent extension of the needles 88 will also enhance the cleaning effect of the gun 80. Furthermore, in common with the other embodiments, the movement of the motor and the action of the valve arrangement 82 will also serve to agitate the gun 80 in the bore, further enhancing the cleaning effect.

Figure 7:
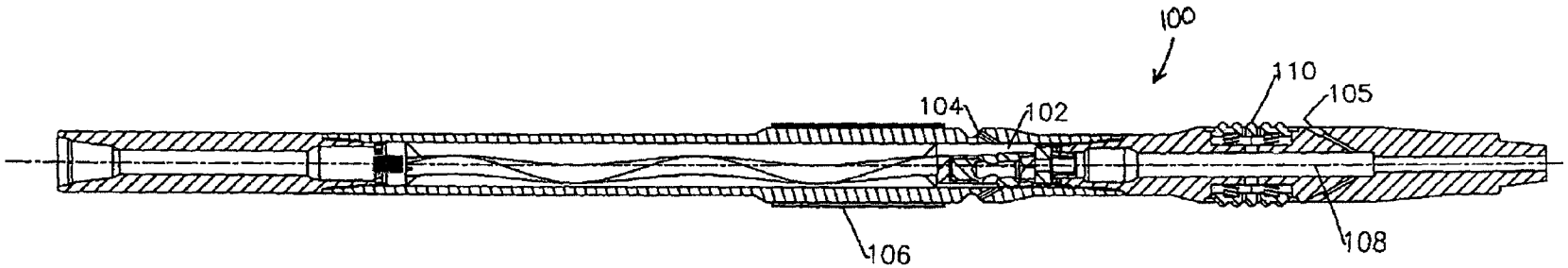
FIG. 7 is a sectional view of a casing scraper tool in accordance with a fifth embodiment of the present invention.

Reference is now made to FIG. 7 of the drawings, which is a sectional view of a casing scraper tool 100 in accordance with a fifth embodiment of the present invention. The tool 100 includes a valve arrangement 102 somewhat like the valve 22 of the tool 10 as described above, in that in one configuration the valve 102 allows fluid to access two locations, and in the other configuration prevents or restricts fluid access to one of the locations. In particular, the valve arrangement 102 is such that, in all configurations of the valve 102, fluid may flow from the motor exhaust to jetting nozzles 104 which direct fluid towards cleaning brushes 106 located on the tool body, externally of the motor.

Below the valve 102 is a fluid manifold 108 in communication with an alternative set of jetting nozzles 105, and also pressure responsive devices in the form of casing scraper blades 110. The blades 110 are spring mounted in the tool body and include pistons such that an elevated fluid pressure within the tool body causes the blades to be urged radially outwardly, into contact with the casing surrounding the tool.

In use, the casing scraper blades 110 will be urged outwardly on an intermittent basis, depending on the valve configuration, and when the valve is configured to isolate the fluid manifold 108 relatively high velocity fluid jets will exit from the nozzles 104 to provide an alternative cleaning effect, and to assist in carrying dislodged material to surface.

Those of skill in the art will recognise that the above-described embodiments provide for useful variations in flow from a downhole tool which is particularly useful in cleaning operations. Also, the flow variations may be usefully employed to actuate fluid responsive devices. Furthermore, the movement of the tools induced by the action of the positive displacement motor and the interruptions or variations in flow caused by the valve will induce movement in the tool which will enhance the cleaning effect.

Although the various embodiments described above are described with reference to downhole operations, it will be apparent to those of skill in the art that the present invention has application in other environments, such as in the cleaning of pipelines and the like.

The invention claimed is:

1. A downhole tool for cleaning a lined subsurface bore comprising:

a body adapted for use within a lined section of the subsurface bore, the body defining a fluid inlet through which fluid may enter the body and a plurality of fluid outlets through which fluid may exit the body and dislodge material from one or more walls of the lined subsurface bore; and a motor driven valve arrangement for selectively varying the percentage by volume of fluid directed from the inlet between at least one of the outlets and at least one other outlet, whereby with the valve arrangement in a first configuration a larger percentage by volume of fluid is directed from the inlet to said at least one of the outlets and a smaller percentage by volume of fluid is directed from the inlet to said at least one other outlet, and with the valve arrangement in a second configuration a smaller percentage by volume of fluid is directed from the inlet to said at least one of the outlets and a larger percentage by volume of fluid is directed from the inlet to said at least one other outlet.

2. The tool of claim 1, wherein groups of fluid outlets are provided, and the valve arrangement is adapted for selectively varying the percentage by volume of fluid directed from the inlet between at least one group of outlets and at least one other group of outlets.

3. The tool of claim 1, wherein the valve arrangement is adapted to cyclically vary the percentage by volume of fluid directed from the inlet between at least one of the outlets and at least one other outlet.

4. The tool of claim 3, wherein the valve arrangement is adapted to change a fluid flow path through the body between the inlet and at least one of the outlets at least once a second.

5. The tool of claim 1, wherein the nature of fluid flows from the different outlets is different.

6. The tool of claim 5, wherein one outlet provides a relatively high velocity flow.

7. The tool of claim 5, wherein one outlet provides a relatively high volume flow.

8. The tool of claim 1, wherein the tool is configured to provide substantially continuous fluid communication between the inlet and at least one of the outlets.

9. The tool of claim 1, wherein the tool defines a fluid flow path from the inlet to an outlet without passing through the valve.

10. The tool of claim 1, wherein the valve arrangement is configured to provide intermittent fluid communication between the inlet and at least one of the outlets.

11. The tool of claim 1, wherein the valve arrangement is arranged to selectively direct fluid from the inlet to at least one pressure responsive device.

12. The tool of claim 11, wherein the pressure responsive device comprises extendable members.

13. The tool of claim 11, wherein the pressure responsive device is in communication with a flow path between the inlet and an outlet.

14. The tool of claim 1, wherein a positive displacement motor drives the valve arrangement.

15. The tool of claim 1, wherein the valve arrangement includes relatively movable valve members, and at least one of the valve members defines at least one flow port.

16. The tool of claim 1, wherein the valve arrangement includes a valve member fixed relative to the body which co-operates with a valve member which is movable relative to the body.

17. The tool of claim 15, wherein the valve arrangement is adapted to control flow by selective alignment of the valve members.

18. The tool of claim 15, wherein a valve member is adapted to rotate relative to the body.

19. The tool of claim 15, wherein a valve member is adapted to move linearly relative to the body.

20. The tool of claim 15, wherein a valve member is adapted to both rotate and move transversely relative to the body.

21. The tool of claim 18, wherein a valve member is mounted to the rotor of a Moineau principle positive displacement motor.

22. The tool of claim 1, wherein the valve arrangement is configured to open and close a flow port which communicates with a group of relatively large flow area outlet ports, and wherein the fluid inlet is in continuous communication with a group of relatively small area flow ports.

23. The tool of claim 1, wherein the valve arrangement is configured to selectively direct fluid to one group of outlet ports and then to another group of outlet ports axially spaced from said one group of outlet ports.

24. The tool of claim 23, wherein a flow-restricting member is provided on the body between the groups of outlet ports.

25. The tool of claim 1, wherein the tool is a cutting tool and the valve arrangement is configured to direct flow to a first jetting nozzle and then to a second jetting nozzle.

26. The tool of claim 25, wherein the jetting nozzles are configured to provide different flow velocities.

27. The tool of claim 25, wherein the jetting nozzles are oriented in different directions.

28. The tool of claim 1, wherein the valve arrangement is configured to open and then close a flow port in a valve member communicating with radially movable pressure-actuated members and fluid outlets for directing fluid towards the members.

29. The tool of claim 28, wherein the pressure-actuated members are cleaning members.

30. The tool of claim 1, wherein the valve arrangement is configured to direct flow to communicate with: a plurality of fluid-actuated members and a set of fluid outlets; and an alternative set of fluid outlets.

31. The tool of claim 30, wherein the fluid-actuated members are in the form of extendable needles.

32. The tool of claim 1, wherein the tool is adapted for location on an end of an elongate support.

33. The tool of claim 32, wherein at least one fluid outlet is provided in a leading end of the tool, and is configured to direct a jet of fluid axially from the end of the tool.

34. The tool of claim 1, wherein the tool is adapted to be agitated in use.

35. A downhole tool for cleaning a lined subsurface bore comprising:

a body adapted for use within a lined section of the subsurface bore, the body defining a fluid inlet through which fluid may enter the body and at least one fluid outlet through which fluid may exit the body;

a fluid pressure responsive cleaning device configured for dislodging material from one or more walls of the lined subsurface bore; and a motor driven valve arrangement for selectively varying the percentage by volume of fluid directed from the inlet to each of the at least one fluid outlet and the fluid pressure responsive cleaning device, whereby with the valve arrangement in a first configuration a larger percentage by volume of fluid is directed from the inlet to said at least one fluid outlet and a smaller percentage by volume of fluid is directed from the inlet to said fluid pressure responsive cleaning device, and with the valve arrangement in a second configuration a smaller percentage by volume of fluid is directed from the inlet to said at least one fluid outlet and a larger percentage by volume of fluid is directed from the inlet to said fluid pressure responsive cleaning device.

36. A method of operating a downhole tool for cleaning a lined subsurface bore, the method comprising:

providing a tool comprising a body adapted for use within a lined section of the subsurface bore, the body defining a fluid inlet through which fluid may enter the body, a plurality of fluid outlets through which fluid may exit the body and dislodge material from one or more walls of the lined subsurface bore, and a motor driven valve arrangement; and driving the valve arrangement to selectively vary the percentage by volume of fluid directed from the inlet between at least one of the outlets and at least one other outlet by reconfiguring the valve arrangement from a first configuration to a second configuration, wherein with the valve arrangement in the first configuration a larger percentage by volume of fluid is directed from the inlet to said at least one of the outlets and a smaller percentage by volume of fluid is directed from the inlet to said at least one other outlet, and wherein with the valve arrangement in the second configuration a smaller percentage by volume of fluid is directed from the inlet to said at least one of the outlets and a larger percentage by volume of fluid is directed from the inlet to said at least one other outlet.

37. The method of claim 36, comprising cyclically varying the percentage by volume of fluid directed from the inlet between at least one of the outlets and at least one other outlet.

38. The tool of claim 35, wherein the fluid pressure responsive cleaning device comprises one or more extendable members.

39. The tool of claim 38, wherein the fluid pressure responsive cleaning device is in communication with a flow path between the inlet and an outlet.

40. The tool of claim 35, wherein the fluid pressure responsive cleaning device comprises one or more cleaning members.

41. The tool of claim 1, wherein the fluid drives the motor driven valve arrangement.

42. The tool of claim 41, wherein the motor driving the valve arrangement comprises a Moineau principle positive displacement motor.

43. The tool of claim 35, wherein the fluid pressure responsive cleaning device comprises a mechanical cleaning device.

44. The tool of claim 35, wherein the fluid pressure responsive cleaning device comprises a hydraulic cleaning device.

45. The tool of claim 12, wherein the extendable members are radially extendable to make contact with a liner or casing.

46. A method of operating a downhole tool for cleaning a lined subsurface bore, the method comprising:

providing a tool comprising a body adapted for use within a lined section of the subsurface bore, the body defining a fluid inlet through which fluid may enter the body and at least one fluid outlet through which fluid may exit the body, the tool further comprising a fluid pressure responsive cleaning device for dislodging material from one or more walls of the lined subsurface bore; and selectively varying the percentage by volume of fluid directed from the inlet to each of the at least one fluid outlet and the fluid pressure responsive cleaning device by reconfiguring a valve arrangement from a first configuration to a second configuration, wherein with the valve arrangement in the first configuration a larger percentage by volume of fluid is directed from the inlet to said at least one fluid outlet and a smaller percentage by volume of fluid is directed from the inlet to said fluid pressure responsive cleaning device, and wherein with the valve arrangement in the second configuration a smaller percentage by volume of fluid is directed from the inlet to said at least one outlet and a larger percentage by volume of fluid is directed from the inlet to said fluid pressure responsive cleaning device.

* * * * *